United States Patent [19]

Tyler

[11] 4,109,120

[45] Aug. 22, 1978

[54] ELECTRICAL UNIT HAVING A BUS-BAR AND A SELECTOR AND METHOD OF MAKING THE SAME

[75] Inventor: Hugh J. Tyler, Santa Ana, Calif.

[73] Assignee: Robertshaw Controls Company, Richmond, Va.

[21] Appl. No.: 736,210

[22] Filed: Oct. 27, 1976

[51] Int. Cl.[2] ..... H01R 13/70

[52] U.S. Cl. ..... 200/51 R; 200/275; 200/290; 361/342; 361/350

[58] Field of Search ..... 200/1 R, 4, 6 R, 6 B, 200/16 R, 16 A, 16 B, 16 C, 51 R, 153 R, 153 B, 156, 163, 238, 239, 243, 250, 275, 290, 336; 361/338, 342, 349, 350, 351, 360, 425

[56] References Cited

U.S. PATENT DOCUMENTS

| | | | |
|---|---|---|---|
| 921,800 | 5/1909 | Clark | 200/51 R |
| 1,894,070 | 1/1933 | Teichner et al. | 200/16 B |
| 1,907,688 | 5/1933 | Von Henke | 200/16 B X |
| 2,846,528 | 8/1958 | Burrell | 200/1 R X |
| 4,032,731 | 6/1977 | Bryceland | 200/16 B |

*Primary Examiner*—Stephen Marcus
*Attorney, Agent, or Firm*—Candor, Candor & Tassone

[57] ABSTRACT

An electrical unit having a frame provided with a terminal means and a bus-bar means electrically interconnected to the terminal means for transmitting electrical current between the terminal means and desired devices electrically interconnected to the bus-bar means, the bus-bar means having a pair of bus-bar sections spaced from each other and having a selector arrangement for electrically interconnecting the bus-bar sections together when the selector arrangement is in one position relative to the frame and for electrically disconnecting the bus-bar sections from each other when the selector arrangement is in another position relative to the frame. The selector arrangement comprises an electrical connector that wedges against both of the bus-bar sections when said selector means is in the one position thereof and a spring is operatively associated with the electrical connector to urge the same into its wedging relation.

9 Claims, 9 Drawing Figures

ELECTRICAL UNIT HAVING A BUS-BAR AND A SELECTOR AND METHOD OF MAKING THE SAME

This invention relates to an improved electrical unit having bus-bar means and to a method of making such a unit or the like.

An electrical unit is provided in the co-pending patent application Ser. No. 661,056, filed Feb. 25, 1976, that contains bus-bar means for electrically interconnecting terminal means of the unit to desired control means whereby power source leads can be interconnected to the terminal means of the unit and the bus-bar means will, in effect, electrically interconnect such power source leads to the desired control means, such unit in the co-pending patent application comprising a fused drawer unit of an electrical furnace whereby fused drawers of the electrical unit can be readily removed from the electrical furnace to effectively disconnect the power source leads therefrom.

It was found that in such a fused drawer unit, it is desired to make the same so that one or two power source leads could be interconnected to each bus-bar means thereof, as desired. One method of accomplishing such feature was to make each bus-bar means from a pair of bus-bar sections disposed spaced from each other and provide a selector means for electrically interconnecting the bus-bar sections together when the selector means is in one position thereof and for electrically disconnecting the bus-bar sections from each other when the selector means is in another position thereof.

A prior selector means for accomplishing the above features comprises an electrical connector that is threadedly fastened to the unit and can be threadedly fastened by a threaded fastening member in one position thereof to bridge against the bus-bar sections and can be threadedly fastened to the unit in another rotational position thereof by the same threaded fastening member to be disposed in the space between the bus-bar sections and out of contact therewith.

It is a feature of this invention to provide an improved selector means of such a bus-bar arrangement.

In particular, one embodiment of the improved selector means of this invention comprises an electrical connection that wedges against both of the bus-bar sections when the selector means is in the position to electrically interconnect the bus-bar sections together.

Such selector means of this invention can include a spring operatively associated with the electrical connector that will urge the electrical connector into its wedging relation against both of the bus-bar sections when the selector means is in a position to electrically interconnect the bus-bar sections together.

Such spring of this invention can also be utilized to move the electrical connector away from the bus-bar sections when the selector means is set in a position thereof to electrically disconnect the bus-bar sections from each other.

Accordingly, it is an object of this invention to provide an improved electrical unit having one or more of the novel features of this invention as set forth above or hereinafter shown or described.

Another object of this invention is to provide an improved method of making such an electrical unit, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
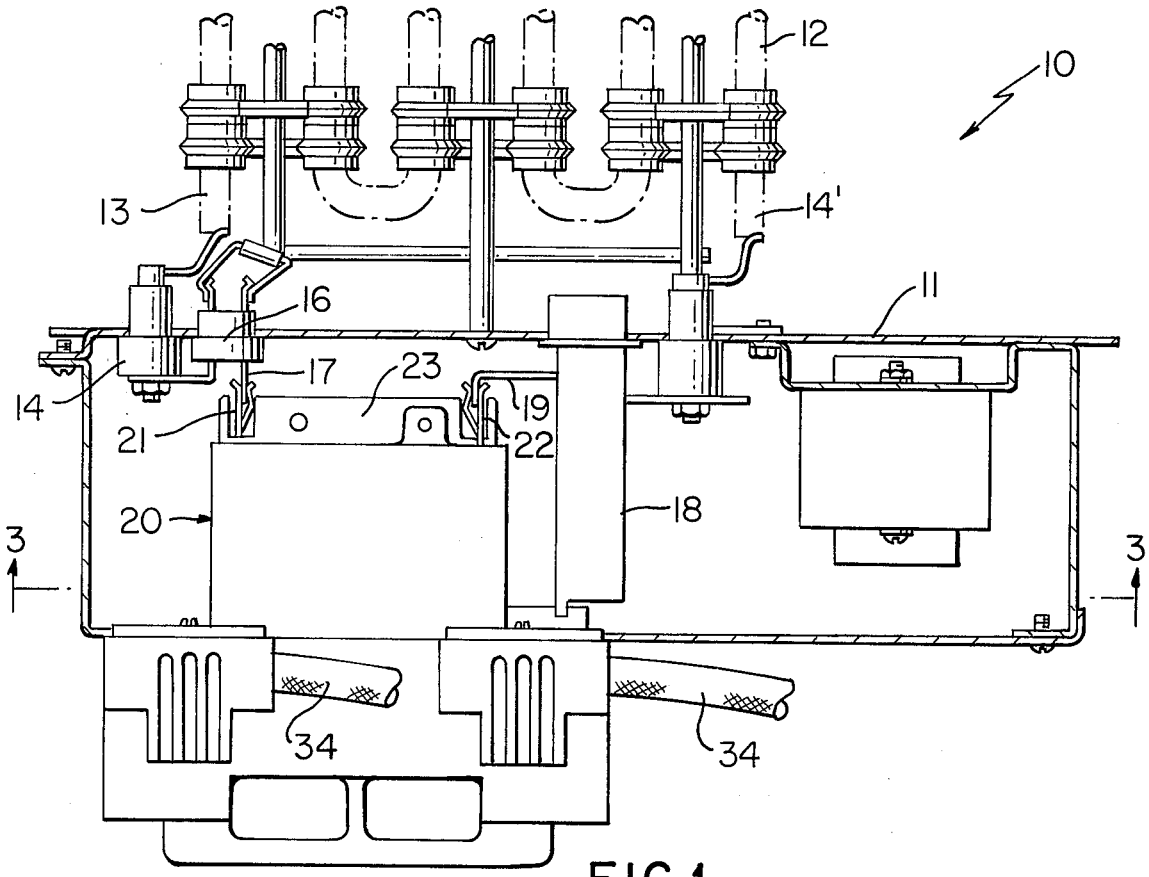
FIG. 1 is a top view of the electrical unit of this invention disposed in an electrical furnace that is shown in fragmentary cross section.

While the various features of this invention are hereinafter described and illustrated as being particularly adapted to provide a fused drawer unit for an electrical furnace, it is to be understood that the various features of this invention can be utilized singly or in any combination thereof to provide a bus-bar arrangement for other types of electrical units as desired.

Therefore, this invention is not to be limited to only the embodiment illustrated in the drawings, because the drawings are merely used to illustrate one of the wide variety of uses of this invention.

Figure 2:
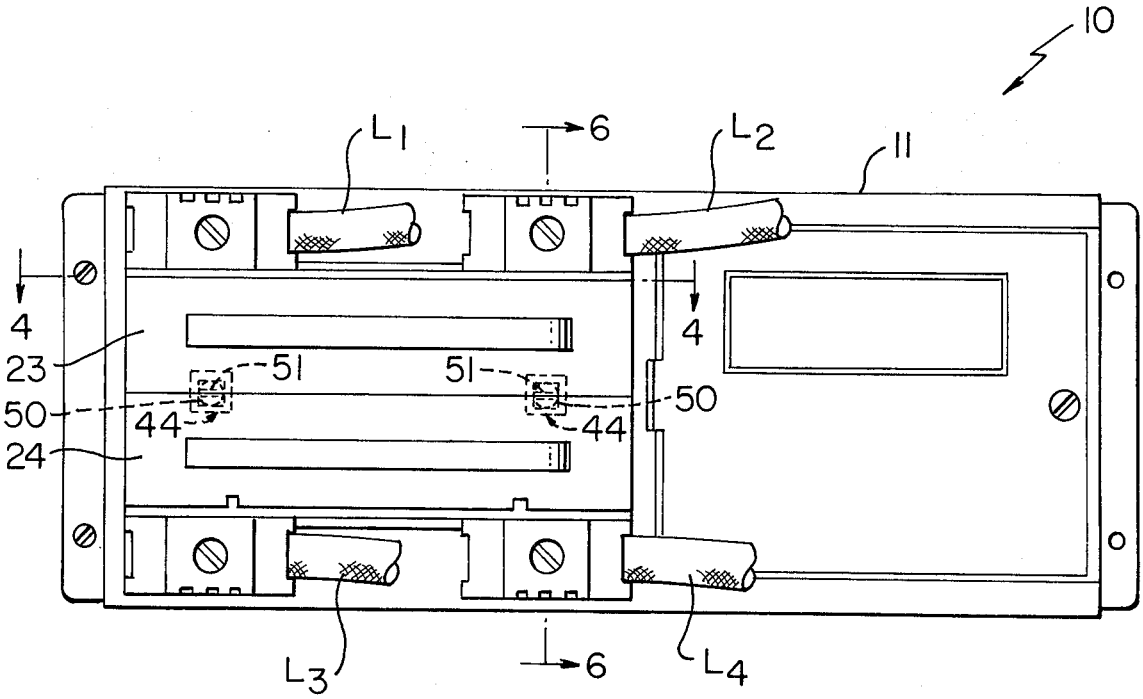
FIG. 2 is a front view of a structure illustrated in FIG. 1.
Figure 3:
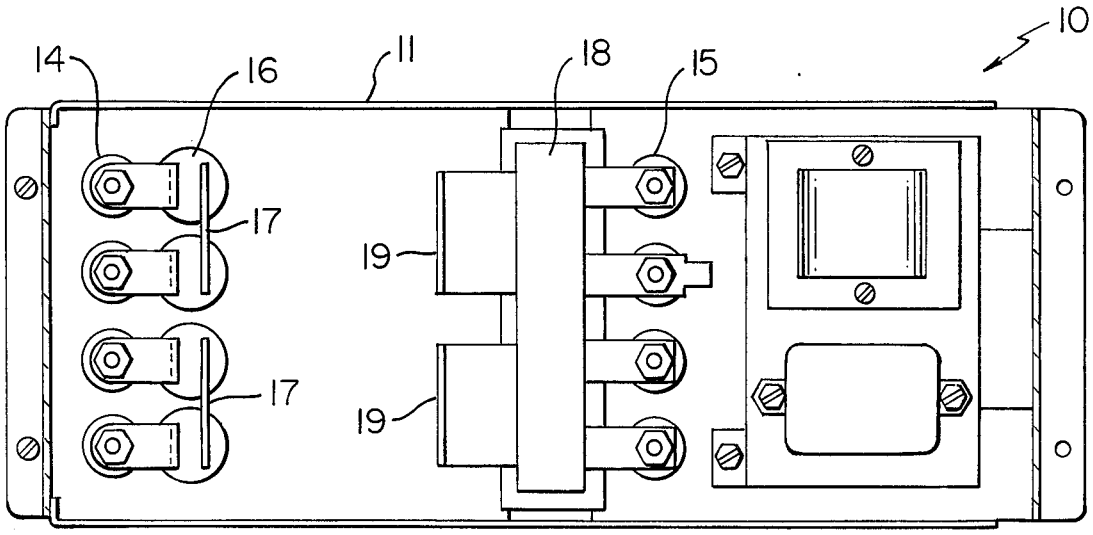
FIG. 3 is a cross-sectional view taken on line 3—3 of FIG. 1.
Figure 4:
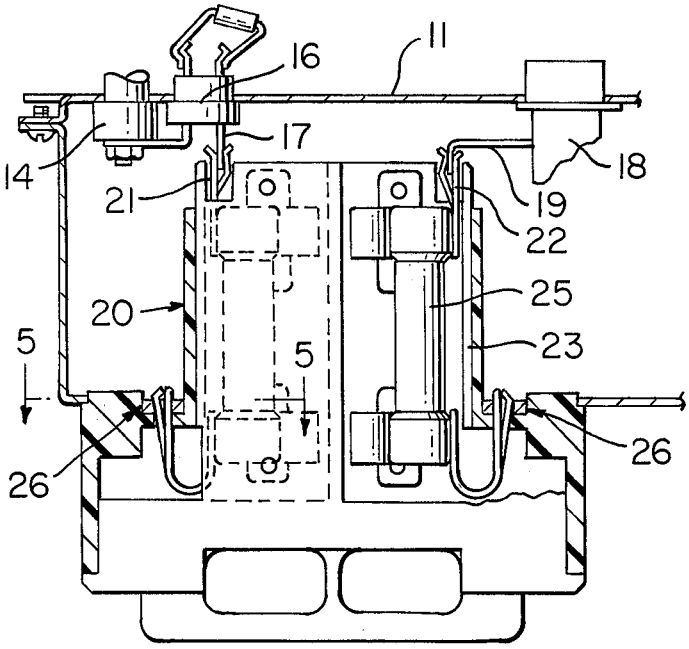
FIG. 4 is a cross-sectional view taken on line 4—4 of FIG. 2.

Referring now to FIGS. 1, 2 and 3, an electrical furnace is generally indicated by the reference numeral 10 and includes a frame means 11 carrying a plurality of electrical heaters 12 and each having opposed ends 13 and 14' thereof respectively electrically interconnected to terminal post means 14 and 15, each terminal post 14 being interconnected through a thermal switch means 16 to a blade-like terminal 17 and each post 15 being interconnected through suitable sequencing switch means 18 to a blade-like terminal 19 as illustrated in FIGS. 1 and 4.

A fused drawer unit 20 has two pairs of blade-like connectors 21 and 22 which are adapted to respectively interconnect with the upper and lower pairs of terminal blades 17 and 19 in a bayonnet-type of interconnection therewith when the upper and lower drawers 23 and 24 of the drawer unit 20 are in their respective "in" positions as illustrated in FIGS. 1 and 4.

In particular, the two drawers 23 and 24 of the drawer unit 20 each has the bayonnet-type connections 21 and 22 for respectively interconnecting with the adjacent terminals 17 and 19 of the devices 16 and 18 as illustrated in FIG. 3 and each drawer 23 and 24 has a pair of fused means 25 respectively and electrically disposed between the bayonnet-like terminals 21 and 22 thereof and a pair of bus-bar means 26 extending throughout substantially the entire height of the drawer unit 20 so as to be interconnected to the respective fuse means 25 of both drawers 23 and 24 when both drawers 23 and 24 are in their "in" positions as fully set forth in the aforementioned co-pending patent application.

Figure 5:
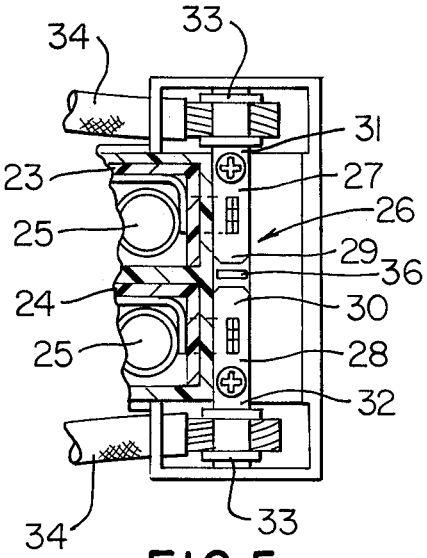
FIG. 5 is a fragmentary cross-sectional view taken on line 5—5 of FIG. 4.

However, each bus-bar means 26 of this invention is formed in the same manner and as illustrated in FIG. 5 comprises two rigid bus-bar sections 27 and 28 respectively having adjacent coplanar ends 29 and 30 thereof disposed spaced from each other and having the other ends 31 and 32 thereof respectively being interconnected to terminal attaching means 33 whereby each terminal attaching means 33 can be attached to a flexible power source lead 34 as will be apparent hereinafter.

Figure 9:
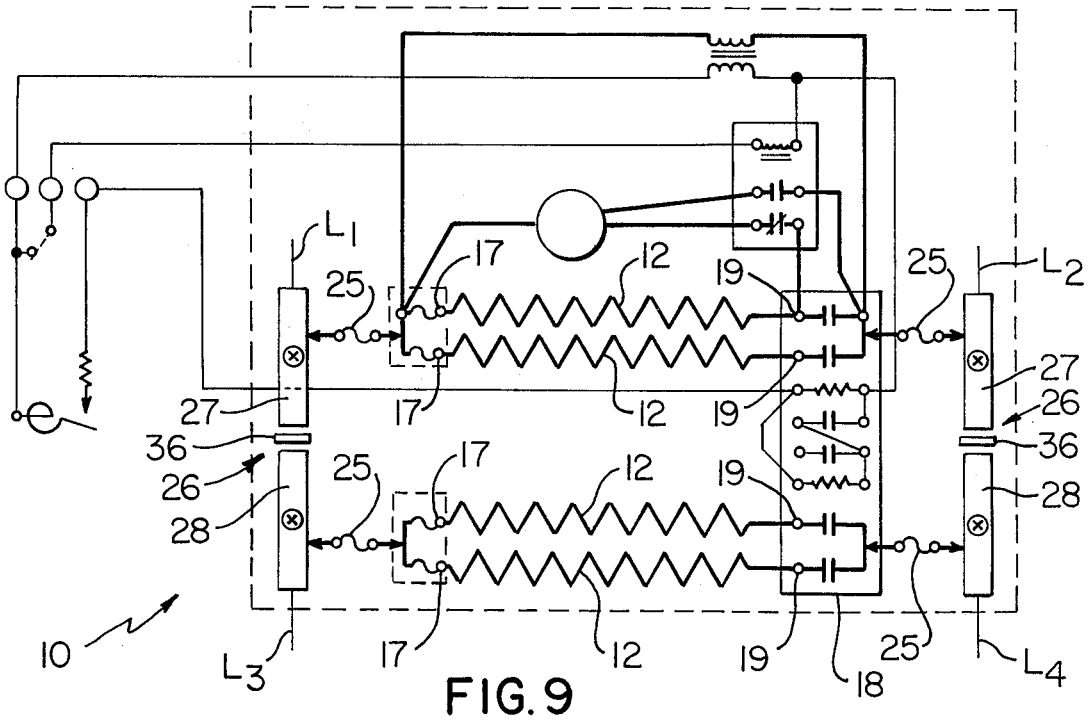
FIG. 9 is a schematic diagram illustrating a typical electrical circuit of the electrical furnace of FIG. 1 and utilizing the features of this invention.

Thus, the upper drawer 23 of the drawer unit 20 can have its terminals 33 respectively interconnected to power source leads L1 and L2 as illustrated in FIGS. 2 and 9 while the lower drawer 24 of the drawer unit 20 can have its terminals 33 respectively interconnected to power source leads L3 and L4 as illustrated in FIGS. 2 and 9.

In this manner, the upper two electrical heaters 12 of the electrical furnace 10 are adapted to have electrical current flow therethrough from the power source lead L1, the left-hand upper bus-bar section 27, upper left-hand fuse 25, upper terminal means 17 upper two electrical heaters 12, the upper terminal means 19, upper right-hand fuse means 25 and the upper right-hand bus-bar section 27 to power source lead L2.

Similarly, the lower pair of electrical heaters 12 of the electrical furnace 10 are adapted to be supplied electrical current from the power source lead L3, the lower left-hand bus-bar section 28, lower left-hand fuse 25 of the lower drawer 24, the lower terminal means 17, lower two electrical heaters 12, the lower terminal means 19, lower right-hand fuse 25 of the lower drawer 24 and the lower right-hand bus-bar section 28 to the power source lead L4.

In this manner, the upper pair of electrical heaters 12 of the electrical furnace 10 are protected by the two fuses 25 in the upper drawer 23 and the lower pair of electrical heaters 12 are protected by the two fuses 25 in the lower drawer 24, the fuses 25 being adapted to be readily replaced when blown by removing the proper drawer 23 and/or 24 in the manner fully set forth in the aforementioned co-pending patent application.

As previously stated, it is a feature of this invention to provide improved selector means whereby the bus-bar sections 27 and 28 of each bus-bar means 26 can be electrically interconnected together when desired so that only one power source lead 34 need be attached thereto at either end thereof rather than the two power source leads 34 at the upper and lower ends thereof as illustrated in FIG. 5.

Figure 6:
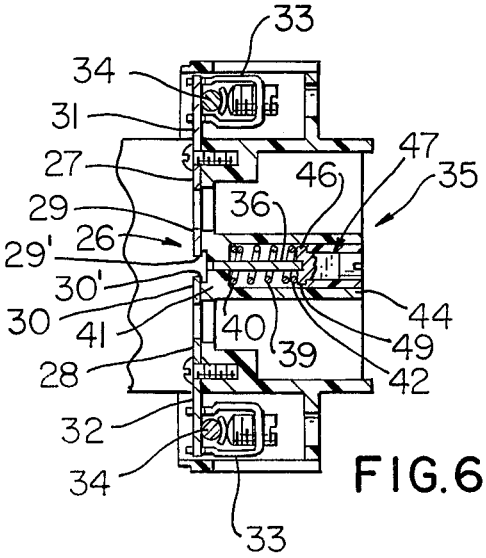
FIG. 6 is a fragmentary cross-sectional view taken on line 6—6 of FIG. 2.
Figure 7:
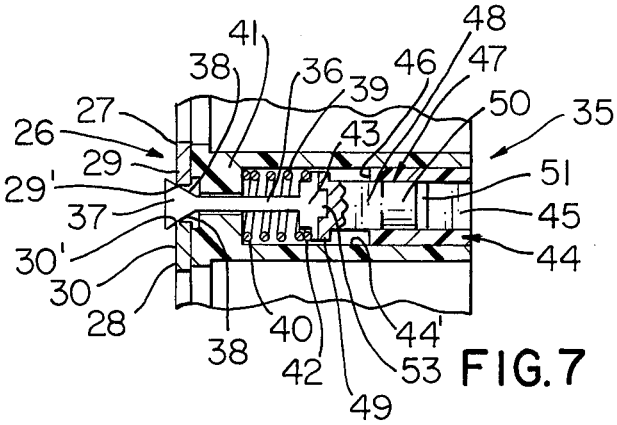
FIG. 7 is an enlarged fragmentary view similar to FIG. 6 and illustrates the selector means of this invention set in a position to electrically interconnect a pair of bus-bar sections together.
Figure 8:
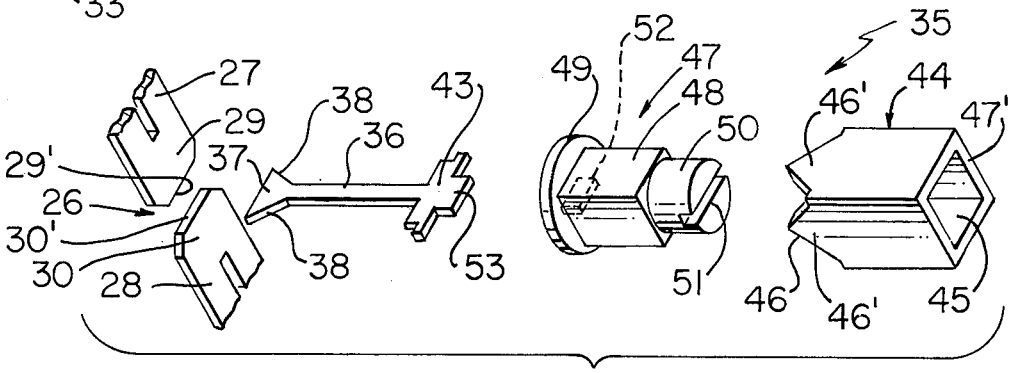
FIG. 8 is an enlarged exploded perspective view illustrating various parts of the selector means of FIG. 7.

This feature is accomplished by the improved selector means of this invention that is generally indicated by the reference numeral 35 in FIGS. 6, 7 and 8.

In particular, each selector means 35 of this invention includes an electrical connector 36 having a substantially triangularly shaped end 37 defined by a pair of angled side edges 38 which are adapted to respectively wedge against the end edges 29' and 30' of the upper and lower bus-bar sections 27 and 28 at the ends 29 and 30 thereof of the respective bus-bar means 26 as illustrated in FIG. 7 when the selector means 35 is in the position of FIG. 7 whereby the bus-bar sections 27 and 28 are effectively electrically interconnected together by the electrical connector 36, the electrical connector 36 being continuously urged into the wedging relation illustrated in FIG. 7 for good contact purposes by a compression spring 39 having one end 40 bearing against the frame means 41 of the drawer unit 20 and the other end 42 thereof bearing against an enlarged end 43 of the electrical connector 36 as illustrated.

A sleeve 44 is carried by the frame 41 of the drawer unit 20 for each selector means 35 and has a substantially square shaped opening 45 passing therethrough and interrupting the opposed ends 46 and 47' thereof, each sleeve 44 being fixed in a chamber 44' of the frame 41 as illustrated. The end 46 of each sleeve 44 is provided with four triangular cam surfaces 46' extending respectively from four sides of the sleeve 44 for a purpose hereinafter described.

A cam member 47 is provided for each selector means 35 and has a square shaped section 48 adapted to be received in the complimentarily shaped opening 45 of the respective sleeve 44 at the end 46 thereof so as to prevent rotation of the cam member 47 relative to the frame 41 for a purpose hereinafter described, each cam member 47 having a disc-like member 49 at one end thereof and a cylindrical projection 50 at the other end thereof that has a screwdriver receiving slot 51 therein.

The disc end 49 of each cam member 47 has a slot 52 therein that is adapted to receive a tongue 53 at the end 43 of its respective electrical connector 36 to thereby prevent rotation between the cam member 47 and the respective electrical connector 36 as the compression spring 39 maintains the tongue 53 in the slot 52 of the cam member 47.

Thus it can be seen that each selector means 35 of this invention can be formed in a simple and effective manner from a relatively few parts to permit the selector means 35 to either electrically interconnect together the upper and lower bus-bar sections 27 and 28 of its respective bus-bar means 26 when the selector means 35 is in the condition illustrated in FIG. 7 or to electrically disconnect the respective bus-bar sections 27 and 28 from each other when the selector means 35 is in the condition of FIGS. 5, 6, and 9 in a manner now to be described.

In the operation of the selector means 35 of this invention, assume that the selector means 35 for each bus-bar section 36 is in the condition illustrated in FIG. 7, so that the bus-bar sections 27 and 28 of each bus-bar means 26 are electrically interconnected together whereby only the power source leads L1 and L2 or L3 and L4 are interconnected thereto to operate the electrical furnace 10 in the manner fully disclosed in the aforementioned co-pending patent application and it is desired to electrically disconnect the upper and lower bus-bar sections 27 and 28 from each other in both bus-bar means 26 so that four power source leads L1, L2, L3 and L4 will be provided for the electrical furnace 10 in the manner illustrated in FIGS. 2 and 9, the operator must first remove the drawers 23 and 24 and then merely inserts a screwdriver into the open end 47 of each selector means 35 and engages the tip of the screwdriver into the slot 51 of the respective cam member 47 and pushes inwardly on the cam member 47 in opposition to the force of the compression spring 39 until the rectangular section 48 of the cam member 47 clears the opening 45 of the respective sleeve 44 and the tips of the triangular cams 46' thereof so that the operator can then rotate the cam member 47 90° from the rotational position illustrated in FIG. 7, such inwardly pushing in of the cam member 47 of each selector means 35 causing the end 37 of the respective electrical connector 36 to be moved to the left beyond the ends 29 and 30 of the bus-bar sections 27 and 28 in FIG. 7 to permit such rotational movement of the electrical connector 36 with the rotational movement of the cam member 47. With the cam member 47 now rotated 90°, the triangular section 37 of the respective electrical connector 36 is likewise rotated 90° and therefore has its triangular part 37 disposed substantially parallel to the end edges 29' and 30' of the respective bus-bar sections 27 and 28 and spaced therefrom in the manner illustrated in FIG. 9 to thereby be electrically disconnected from the bus-bar sections 27 and 28.

With the cam member 47 now in the new rotational position thereof, the operator pulls back on the screwdriver allowing the compression spring 39 to move the respective cam member 47 and its associated electrical connector 36 to move to the right in FIG. 6 under the force of the respective compression spring 39 until the disc-like member 49 abuts against the end 46 of the sleeve 44 at which time the end 37 of the electrical connector 36 is fully pulled away from the bus-bar sections 27 and 28 as illustrated in FIG. 6 to be in an out-of-way position relative thereto and is held in such out-of-way position by the compression spring 39.

The cam surfaces 46' of the sleeve 44 insure that the cam member 47 is turned substantially 90° because the same will cam against the square section 48 of the cam member if it is not turned exactly 90° from the position of FIG. 7 and cause the square section 48 to align either in the position of FIG. 6 or the position of FIG. 7. Thus, the cam member 47 and thus the connector 36 can not be positioned in any rotational position between the desired positions of FIGS. 6 and 7 before the cam member 47 can be received in the opening 45 of its respective sleeve 44.

Thus, by so operating both of the selector means 35 in the above manner, the drawer unit 20 is now converted from the two power line arrangement of FIG. 7 to a four power line arrangement of FIG. 9 requiring the four power source leads L1, L2, L3 and L4 to be respectively interconnected thereto in the manner illustrated in FIGS. 5 and 9 in order to provide electrical current for all of the electrical heaters 12 as previously described once the drawers 23 and 24 have been reinserted in place as illustrated in FIG. 2.

Should it be desired to reconvert the drawer unit 20 from the four power source lead arrangement back to the two power source lead arrangement, the power source leads L3 and L4 (or power source leads L1 and L2) are detacted therefrom and the drawers 23 and 24 are removed. The operator then inserts a screwdriver into the slot 51 of each cam member 47 to push inwardly on the same in opposition to the force of the compression spring 39 and cause the rectangular part 48 of the respective cam member 47 to clear the opening 45 and tips 46' of the sleeve 44 at which time the end 37 of the electrical connector 36 has been passed through and beyond the spacing between the ends 29 and 30 of the respective upper and lower bus-bar sections 27 and 28. With the cam member 47 in its pushed-in condition, the operator then rotates the cam member 47 one-quarter turn (90°) so that the triangular part 37 of the electrical connector 36 is now in the position of FIG. 7 whereby upon a subsequent backing out of the screwdriver, the force of the compression spring 39 not only causes part of the rectangular section 48 of the cam member 47 to enter into the opening 45 of the respective sleeve 44, but to also urge the angled edges 38 of the triangular end 37 of the electrical connector 36 into good wedging relation with the end edges 29' and 30' of the upper and lower bus-bar sections 27 and 28 to electrically interconnect the same together and maintain good electrical contact therebetween through the force of the compression spring 39.

Because part of the rectangular section 48 of the cam member 47 of each selector means 36 is in the respective sleeve 44 when the respective selector means 35 is in the condition of the electrical connector 36 of FIG. 7, the electrical connector 36 is, in effect, locked in the electrical interconnecting condition of FIG. 7 until it is desired to convert the same back to the electrical disconnecting condition of FIG. 6 for the reasons previously set forth.

Thus, it can be seen that the selector means 35 for each bus-bar section 26 is locked in either the electrical interconnecting condition for FIG. 7 or the electrical disconnecting condition of FIG. 6 by the cooperation of the rectangular section 48 of the respective cam member 47 with the opening 45 of the respective sleeve 44 under the influence of the respective compression spring 39, the triangular parts 46' of the respective sleeve 44 insuring that the connector 36 thereof is only in the position of FIG. 6 or FIG. 7 and not in a rotational position therebetween.

Also, it can be seen that since the slot 51 of each cam member 47 is coplanar with the triangular end 37 of its respective electrical connector 36, the slot 51 serves as an indicator of the position of the electrical connector 36. For example, when the slots 51 are horizontal as illustrated in FIGS. 2 and 6, the electrical connectors 36 are not in their bridging contact relation. However, when the slots 51 are vertical as illustrated in FIG. 7, the connectors 36 are in their electrical bridging relation.

Further, it can be seen from FIG. 2 that the drawers 23 and 24 hide the selector means 35 and must be completely removed from the unit 10 before the slots 51 of the cam members 47 are exposed for changing the positions thereof whereby the selector means 35 can not be changed wth the unit 10 under power as the unit 10 must have the drawers 23 and 24 removed before changing over can be accomplished.

Thus, it can be seen that this invention not only provides an improved electrical unit having selectively operable bus-bar means thereof, but also this invention provides an improved method of making such an electrical unit or the like.

While the forms and methods of this invention have been described and illustrated as required by the Patent Statute, other forms and methods can be utilized and still fall within the scope of the appended claims.

What is claimed is:

1. In an electrical unit having a frame provided with a terminal and a bus-bar electrically interconnected to said terminal for transmitting electrical current between said terminal and desired means electrically interconnected to said bus-bar, said bus-bar having a pair of bus-bar sections spaced from each other and having a selector for electrically interconnecting said bus-bar sections together when said selector is in one position relative to said frame and for electrically disconnecting said bus-bar sections from each other when said selector is in another position relative to said frame, the improvement wherein said selector comprises an electrical connector that wedges against both of said bus-bar sections when said selector is in said one position thereof, said bus-bar sections respectively having adjacent ends thereof disposed spaced from each other and respectively having end edges disposed spaced and parallel to each other, said electrical connector wedging against both of said adjacent ends of said bus-bar sections when said selector is in said one position thereof, said electrical connector having a substantially flat triangularly shaped part that defines a pair of angled edges that respectively wedge against said adjacent ends of said bus-bar sections when said selector is in said one position thereof, said triangular part of said connector wedging against said end edges when disposed transverse thereto by said selector being in said one position thereof and being disposed spaced inwardly from and parallel to said end edges when said selector is in said other position thereof.

2. An electrical unit as set forth in claim 1 wherein a spring is carried by said frame and is operatively associated with said electrical connector to urge said electrical connector into said wedging relation with said bus-bar sections when said selector is in said one position thereof.

3. An electrical unit as set forth in claim 1 wherein said electrical connector is movably carried by said frame, said selector moving said electrical connector away from said bus-bar sections when said selector is in said other position thereof.

4. An electrical unit as set forth in claim 3 wherein a spring is carried by said frame and is operatively associated with said electrical connector to urge said electrical connector into said wedging relation with said bus-bar sections when said selector is in said one position thereof and to urge said electrical connector away from said bus-bar sections when said selector is in said other position thereof.

5. An electrical unit as set forth in claim 4 wherein said electrical connector is rotatable relative to said frame, said selector disposing said electrical connector in one rotational position thereof when said selector is in said one position thereof and disposing said electrical connector in another rotational position thereof when said selector is in said other position thereof.

6. An electrical unit as set forth in claim 5 wherein said selector has means for locking said electrical connector in said one rotational position thereof.

7. An electrical unit as set forth in claim 5 wherein said selector has means for locking said electrical connector in said other rotational position thereof.

8. In a method of making an electrical unit having a frame provided with a terminal and a bus-bar electrically interconnected to said terminal for transmitting electrical current between said terminal and desired means electrically interconnected to said bus-bar, said bus-bar having a pair of bus-bar sections spaced from each other and having a selector for electrically interconnecting said bus-bar sections together when said selector is in one position relative to said frame and for electrically disconnecting said bus-bar sections from each other when said selector is in another position relative to said frame, the improvement comprising the steps of forming said selector with an electrical connector that wedges against both of said bus-bar sections when said selector is in said one position thereof, and forming said eletrical connector with a substantially flat triangularly shaped part that defines a pair of angled edges that respectively wedge against adjacent ends of said bus-bar sections when said selector is in said one position thereof to dispose said flat triangular part transverse to spaced parallel end edges of said adjacent ends and to dispose said flat triangular part spaced inwardly from said parallel to said end edges when said selector is in said other position thereof.

9. A method as set forth in claim 8 wherein said step of forming said selector includes the step of operatively associating a spring with said electrical connector to urge said electrical connector into said wedging relation with said bus-bar sections when said selector is in said one position thereof.

* * * * *